US006431949B1

(12) United States Patent
Ishikawa et al.

(10) Patent No.: US 6,431,949 B1
(45) Date of Patent: Aug. 13, 2002

(54) PLANARIZATION APPARATUS

(75) Inventors: Toshihiko Ishikawa; Yasushi Katagiri, both of Mitaka (JP)

(73) Assignee: Tokyo Seimitsu Co., Ltd., Mitaka (JP)

( * ) Notice: Subject to any disclaimer, the term of this patent is extended or adjusted under 35 U.S.C. 154(b) by 35 days.

(21) Appl. No.: 09/613,558

(22) Filed: Jul. 10, 2000

(30) Foreign Application Priority Data

Jul. 9, 1999 (JP) ..... 11-195943

(51) Int. Cl.[7] ..... B24B 49/00; B24B 51/00

(52) U.S. Cl. ..... 451/5; 451/8; 451/21; 451/72; 451/443

(58) Field of Search ..... 451/21, 56, 72, 451/259, 5, 8, 6, 9, 10, 443

(56) References Cited

U.S. PATENT DOCUMENTS 5,456,627 A * 10/1995 Jackson et al. ..... 451/11
5,890,951 A 4/1999 Vu
5,931,722 A 8/1999 Ohmi et al.
5,948,203 A * 9/1999 Wang ..... 156/346

FOREIGN PATENT DOCUMENTS

GB 2 324 750 11/1998
JP 9-277160 10/1997

* cited by examiner

*Primary Examiner*—Timothy V. Eley
(74) *Attorney, Agent, or Firm*—Nixon Peabody LLP; David S. Safran

(57) ABSTRACT

A planarization apparatus has a stocker in which a dressing board is stored. The dressing board is picked up from the stocker and mounted on a chuck table by a transport robot. Then, dressing of a grinding wheel or a polishing pad is performed with the dressing board. Thereafter, the used dressing board is withdrawn into the stocker by the transport robot after the process through cleaning and drying.

6 Claims, 5 Drawing Sheets

PLANARIZATION APPARATUS

BACKGROUND OF THE INVENTION

1. Field of the Invention

The present invention relates generally to a planarization apparatus, specifically to a planarization apparatus which performs a grinding process for a back face of a semiconductor wafer in a manufacturing process.

2. Description of Related Art

In a planarization apparatus of this type, dressing of a grinding wheel and a polishing pad is performed using a dressing board. The dressing board is made of a dressing stone, for dressing the grinding wheel or the polishing pad, processed in a disk shape like the wafer, and the dressing board is mounted on a table for holding the wafer in order to be used. The dressing board is mounted on the table just like the wafer to be processed, and the grinding wheel or the polishing pad is rotated and pressed against the dressing board whereby the grinding wheel or the polishing pad is dressed.

In a conventional art, the dressing is performed by an operator. In other words, the operator mounts the dressing board on the table, and after the dressing, the operator withdraws the dressing board from the table, all manually.

However, when performing the conventional dressing by the operator manually, the process is interrupted if the dressing is required during one lot, and the process has to be restarted after the dressing; as a result, throughput efficiency is lowered.

On the other hand, since IC cards have come into demand, a planarization apparatus such as a back grinder and a polisher which grinds and makes the back face of the wafer thin processes the wafer as thin as 301 m like paper. Hence, sharpness of the grinding wheel or a condition of the polishing pad directly affects processing accuracy. Because of that the grinding wheel or the polishing pad must be maintained in a fine condition; in the conventional art, however, if the operator performs manually the dressing, there is inconsistency in time and accuracy; in addition, other errors will occur.

SUMMARY OF THE INVENTION

The present invention has been developed in view of the above-described circumstances, and has as its object the provision of a planarization apparatus which can automatically dress the grinding wheel or the polishing pad.

In order to achieve the above-described objects, the present invention is directed to a planarization apparatus, comprising: a table which holds a first face of a wafer by suction; one of a grinding wheel and a polishing pad, the table and the one of the grinding wheel and the polishing pad being moved relatively close to each other to press the one of the grinding wheel and the polishing pad on a second face of the wafer on the table and being rotated relatively to each other so as to process the second face of the wafer on the table; a dressing board, the one of the grinding wheel and the polishing pad being, when the table holds the dressing board instead of the wafer, pressed on the dressing board on the table so as to dress the one of the grinding wheel and the polishing pad; a stocker which stocks the dressing board; a transporting device which picks up the dressing board from the stocker, transports the dressing board to the table, withdraws the dressing board from the table, and stores the dressing board in the stocker; and a controller which controls the transporting device and executes dressing of the one of the grinding wheel and the polishing pad.

According to the present invention, when the grinding wheel or the polishing pad is dressed, the transporting device picks up the dressing board from the stocker, and transports the dressing board on the table. Then, the rotating grinding wheel or the rotating polishing pad and the table are moved relatively close together so that the dressing board is pressed against the grinding wheel or the polishing pad, thereby the grinding wheel or the polishing pad is dressed. After the dressing is completed, the transporting device withdraws the dressing board from the table and stores the dressing board in the stocker. Thus, the grinding wheel or the polishing pad can be automatically dressed.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENT

Hereunder preferred embodiments of a planarization apparatus of the present invention will be described in detail according to the accompanying drawings.

Figure 1:
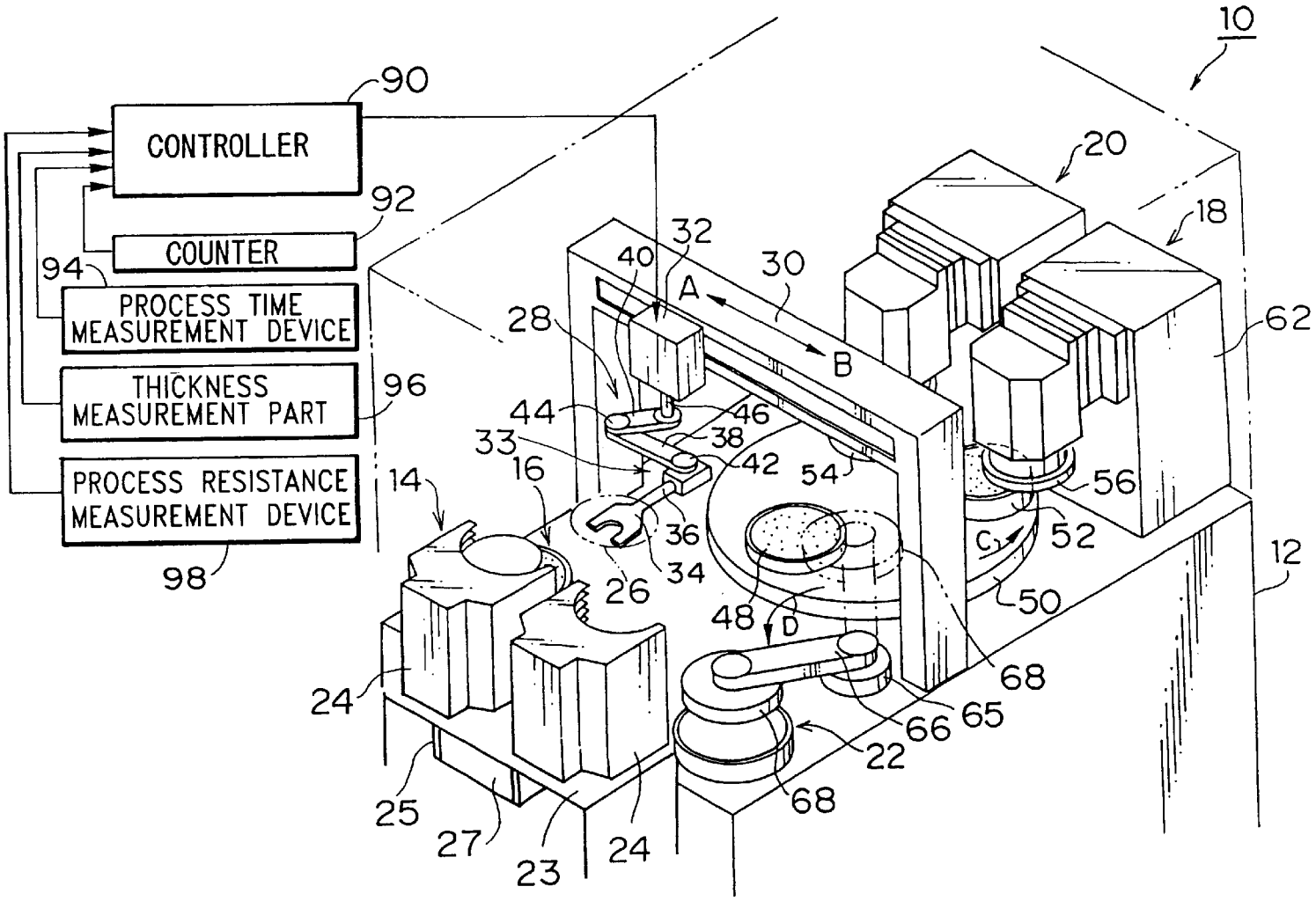
FIG. 1 is a perspective view of a planarization apparatus according to a first ebodiment of the present invention.
Figure 2:
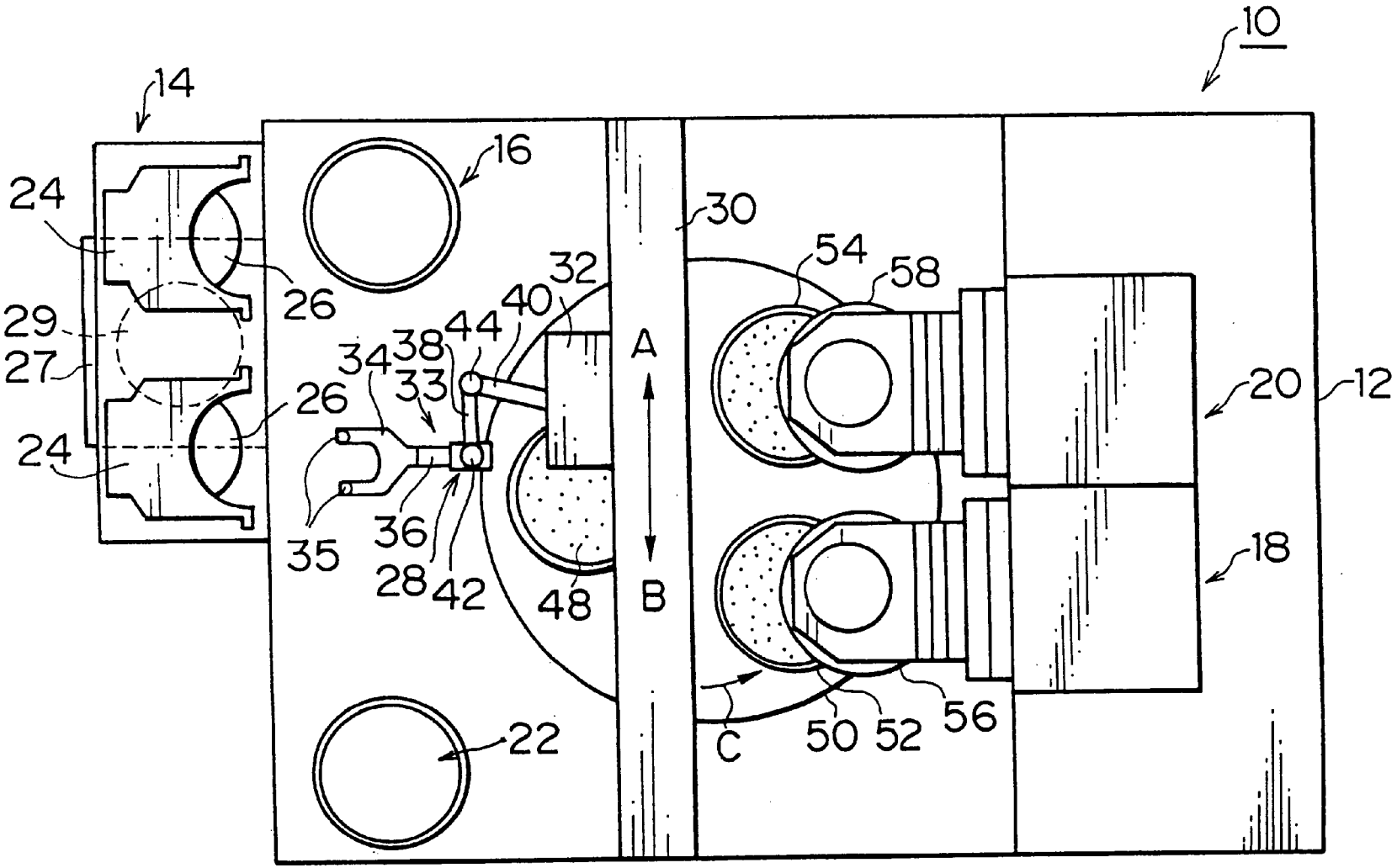
FIG. 2 is a plan view of the planarization apparatus in FIG. 1.
Figure 3:
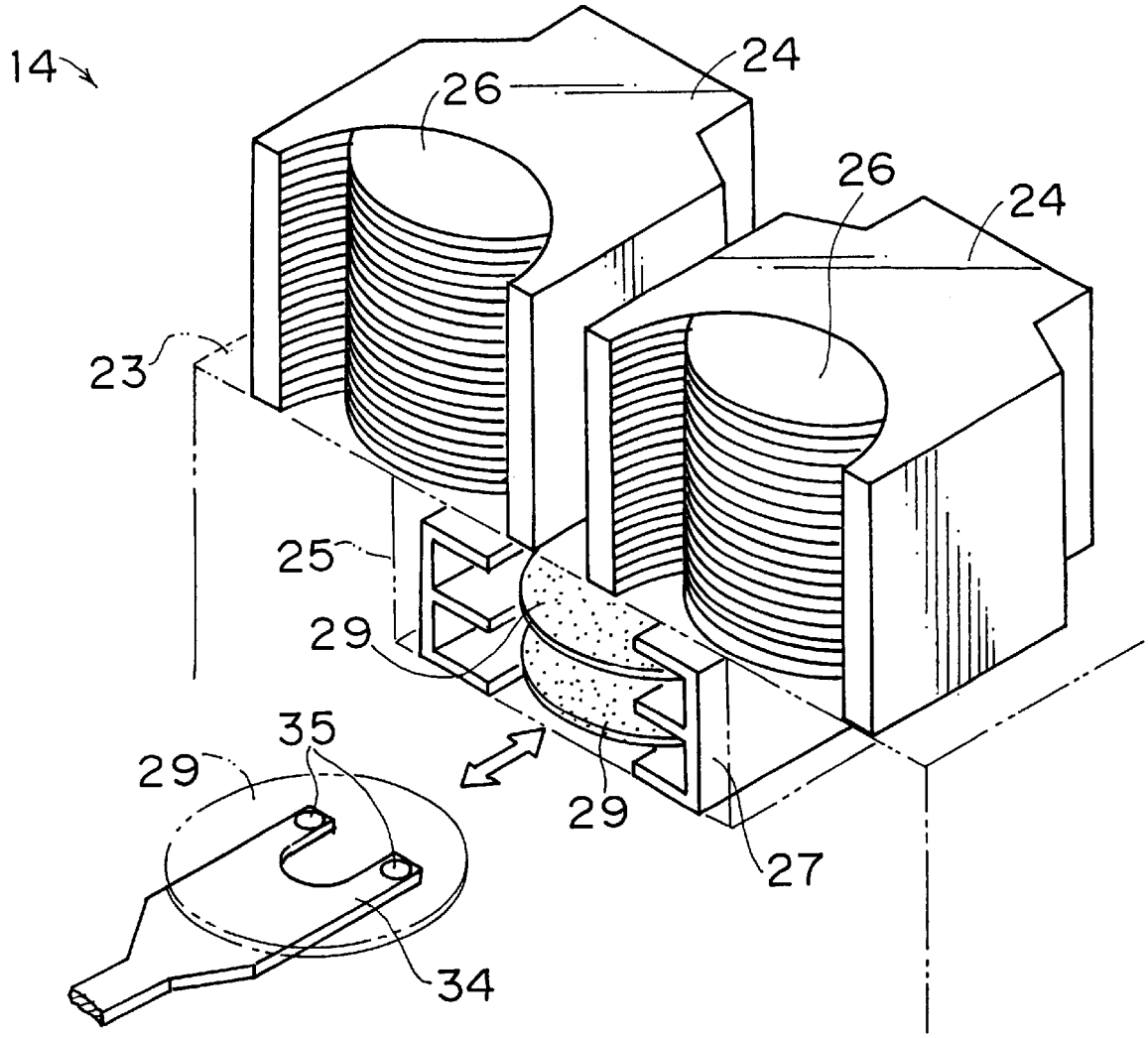
FIG. 3 is a perspective view showing the construction of a cassette storing stage.

FIGS. 1 and 2 are a perspective view and a plan view of a planarization apparatus according to the first embodiment of the present invention.

As shown in FIGS. 1 and 2, the planarization apparatus 10 comprises in a body 12 a cassette storing stage 14, an alignment stage 16, a rough grinding stage 18, a fine grinding stage 20, and a cleaning stage 22.

A cassette stage 23 is provided at the cassette storing stage 14, and cassettes 24 and 24 are detachably mounted on cassette mounting parts of the cassette stage 23. At the bottom of the cassette mounting parts, a stocker shelf 25 is provided, on which a stocker 27 is detachably mounted.

Wafers 26, 26, . . . which have not been processed are stored in the two cassettes 24 and 24, which are mounted on the cassette stage 23. The wafers 26, 26, . . . are individually picked up and transported to the alignment stage 16 by a transport robot 28.

The stocker 27, mounted on the storage shelf 25, has a shelf, in which dressing boards 29 and 29 can be separately stored. The dressing boards 29 and 29, contained in the stocker 27, are individually picked up and transported to the alignment stage 16 by the transport robot 28 just like the wafer 26.

As described before, the dressing board 29 is made of a dressing stone which is formed in a disk shape like the wafer 26, for dressing the grinding wheel or the polishing pad, and the back face of the dressing board 29 is planarized. Dressing boards are prepared individually for a rough grinding wheel and a fine grinding wheel.

The transport robot 28 for transporting the wafer 26 and the dressing board 29 is a common industrial robot, which comprises a bendable multi-joints arm 33 and a hand 34 provided to the tip of the multi-joints arm 33, and is suspended via an elevator 32 to a beam 30, which is provided to the body 12.

The hand 34 is in a shape of Y, whose tips are provided with suction pads 35 and 35. The wafer 26 and the dressing board 29 are held to the suction pads of the hand 34 by suction.

The multi-joints arm 33 comprises three arms 36, 38, and 40. The hand 34 is rotatably supported at the tip of the arm 36 (first arm), and rotates around an axis of the first arm 36, which is driven by a motor (not shown). The first arm 36 is rotatably connected to the tip of the arm 38 (second arm) with an axis 42, and is rotated by a motor (not shown) around the axis 42. The second arm 38 is rotatably connected to the tip of the arm 40 (third arm) with an axis 44, and is rotated by a motor (not shown) around the axis 44. The third arm 40 is connected with an output shaft of a motor (not shown) through an axis 46, and is rotated by the motor around the axis 46. This motor is connected with an elevating rod (not shown) of the elevator 32, and the motor is moved up and down by extension and contraction of the elevating rod. As a feed screw device (not shown) built in the beam 30 drives the elevator 32, the elevator 32 moves back and forth in a direction along which the beam 30 is provided; thereby the transport robot 28 moves back and forth in directions of arrows A and B in FIGS. 1 and 2 in the direction along which the beam 30 is provided.

The transport robot 28, constructed as described above, controls the motions of the hand 34 and the three arms 36, 38, and 40 individually, and controls the extension and contraction of the elevating rod of the elevator 32, whereby the transport robot 28 can pick up and transport the wafer 26 or the dressing board 29, which is stored in the cassette 24 or the stocker 27, to the alignment stage 16. A controller 90 controls the driving of the transport robot 28, which moves in accordance with a drive signal of the controller 90.

The alignment stage 16 aligns the wafer 26 or the dressing board 29 which is transported from the cassette 24 at a predetermined position. The wafer 26 or the dressing board 29 which is aligned at the alignment stage 16 is transported by the transport robot 28 to an empty chuck table 48 which is positioned at a wafer receiving position.

The wafer receiving position is where three chuck tables 48, 52, and 54, which are provided to a turn table 50, receive the wafer 26. (In FIG. 1, the chuck table 48 is positioned at the wafer receiving position, the chuck table 52 is positioned at the rough grinding stage 18, and the chuck table 54 is positioned at the fine grinding stage 20). These three chuck tables 48, 52, and 54 are placed on the turntable 50 with predetermined distances, and are rotated by motors (not shown).

The wafer 26 that is held by suction on the chuck table 48 (52, 54) is positioned at the wafer receiving position, and the thickness of the wafer 26 is measured by a measurement gage (not shown). The measured wafer 26 is positioned at the rough grinding stage 18 by the rotation of the turntable 50 in a direction of an arrow C in FIG. 1.

The rough grinding stage 18 performs rough grinding on the wafer 26, specifically, the rough grinding stage 18 presses a rotating grinding wheel 56 against the wafer 26 from above which is held and rotated by the chuck table 52 (48, 54), and roughly grinds the wafer 26. The wafer 26 at that point is roughly ground in accordance with a result of the thickness measurement. The thickness of the wafer 26 that has been roughly ground at the rough grinding stage 18 is measured by a thickness measurement gage (not shown) after the grinding wheel 56 retreats from the wafer 26. The measured wafer 26 is then positioned at the fine grinding stage 20 by the rotation of the turntable 50 in the direction of the arrow C in FIG. 1.

The fine grinding stage 20 finely grinds the wafer 26, specifically, the fine grinding stage 20 presses a rotating grinding wheel 58 against the wafer 26 from above which is held and rotated by the chuck table 54 (48, 52), and finely grinds the wafer 26, then performs spark-out. The wafer 26 at that point is finely ground in accordance with a result of the thickness measurement after the rough grinding. The wafer 26 that has been finely ground at the fine grinding stage 20 is transported to the position of the empty chuck table 48 in FIG. 1 by the rotation of the turn table 50 in the direction of the arrow C in FIGS. 1 and 2 after the grinding wheel 58 retreats from the wafer 26. Then, the wafer 26 is transported to the cleaning stage 22 by a transfer robot 62.

The cleaning stage 22 cleans by spin cleaning and dries by spin dry the processed wafer 26 or the dressing board 29 that has performed the dressing.

The transfer robot 62 is a common industrial robot like the transport robot 28, and comprises an arm 66, which is swiveled by driving of a motor 65 and also moves up and down by driving of a cylinder (not shown), and a suction pad 68 provided at the tip of the arm 66. The wafer 26 is held by suction to the suction pad 68 and is transferred from the chuck table 48 to the cleaning stage 22 by the swiveling motion of the arm 66.

The wafer 26 which is cleaned and dried at the cleaning stage 22 is held and transported to the cassette storing stage 14 by the transport robot 28, and is stored in a predetermined shelf of the predetermined cassette 24. The dressing board 29 which is cleaned and dried at the cleaning stage 22 is held and transported to the cassette storing stage 14 by the transport robot 28, and is stored in the predetermined shelf of the stocker 27.

An operation of the planarization apparatus 10 constructed as presented above in the present embodiment is as described below.

First, the operator mounts the cassettes 24 and 24 in which a number of unprocessed wafers 26 are stored on the cassette stage 23 of the cassette storing stage 14, and at the same time, the operator mounts the stocker 27 in which the dressing board 29 is stored on the stocker shelf 25, then starts the apparatus.

As the apparatus is started, the transport robot 28 picks up one wafer 26 from the cassette 24 and transports it to the alignment stage 16. The transported wafer 26 is aligned at the predetermined position at the alignment stage 16. As the aligning is completed, the wafer 26 is transported to the chuck table 48 which is positioned at the wafer receiving position, and is held by suction on the chuck table 48.

The thickness of the wafer 26, held on the chuck table 48, is measured by the measurement gage (not shown). The wafer 26 is then transported to the rough grinding stage 18 by the rotation of the turntable 50, and roughly ground at the rough grinding stage 18. More specifically, as shown in FIG. 1, the chuck table 52 is rotated and the grinding wheel 56 is rotated, and the rotating grinding wheel 56 is lowered toward the rotating chuck table 52, and thus, the rotating grinding wheel 56 is pressed against the rotating wafer 26 so as to roughly grind the wafer 26.

When the rough grinding is completed, the grinding wheel 56 retreats from the wafer 26, and the thickness of the wafer 26 is measured by the thickness measurement gage (not shown). After that, the wafer 26 is transported to the fine grinding stage 20 by the rotation of the turn table 50, and finely ground at the fine grinding stage 20, then the spark-out is performed. As shown in FIG. 1, the chuck table 54 is rotated and the grinding wheel 58 is rotated, and the rotating grinding wheel 58 is lowered toward the rotating chuck 20 table 54, and thus, the rotating grinding wheel 58 is pressed against the rotating wafer 26, so that the wafer 26 is finely ground and the spark-out is performed.

As the fine grinding is completed, the grinding wheel 58 retreats from the wafer 26. Then, the turntable 50 rotates and the wafer 26 is positioned at the wafer receiving position. The wafer 26 positioned at the wafer receiving position is released from the suction of the chuck table 48, and is transported to the cleaning stage 22 by the transfer robot 62, then, is cleaned and dried at the cleaning stage 22.

The cleaned and dried wafer 26 is withdrawn from the cleaning stage 22 by the transport robot 28, and is transported to the cassette storing stage 14 so as to be stored in the predetermined shelf of the predetermined cassette 24.

The process for one wafer 26 is thus completed. Thereafter, the wafers 26 which are stocked in the cassettes 24 are successively processed in the same procedure.

A main controller (not shown) of the planarization apparatus 10 counts a number of processed wafers 26 by a built-in counter 92, and outputs the number of the processed wafers 26 to the controller 90. The controller 90 interrupts the process of the wafers when the number of the processed wafers 26 reaches a predetermined number for dressing which is set beforehand by the operator, and executes dressing which is presented below.

First, the transport robot 28 picks up the dressing board 29 for the rough grinding wheel from the stocker 27, and transports the dressing board 29 to the alignment stage 16. The transported dressing board 29 is aligned at the predetermined position at the alignment stage 16. As the alignment is completed, the dressing board 29 is transported from the alignment stage 16 to the chuck table 48 which is positioned at the wafer receiving position, and held by suction on the chuck table 48.

As the dressing board 29 is held on the chuck table 48, the turntable 50 rotates and the dressing board 29 is transported to the rough grinding stage 18. As the dressing board 29 is transported to the rough grinding stage 18, the dressing of the grinding wheel 56, which is provided to the rough grinding stage 18, starts. In other words, the chuck table 52 is rotated and the grinding wheel 56 is rotated, and the rotating grinding wheel 56 is lowered toward the rotating chuck table 52, and thus the rotating grinding wheel 56 is pressed against the rotating dressing board 29 so as to dress the grinding wheel 56.

When the dressing is completed, the grinding wheel 56 retreats from the dressing board 29. The turn table 50 then rotates whereby the dressing board 29 is positioned at the wafer receiving position. The dressing board 29, positioned at the wafer receiving position, is released from the suction of the chuck table 48, and is transported to the cleaning stage 22 by the transfer robot 62, then, is cleaned and dried at the cleaning stage 22. The cleaned and dried dressing board 29 is withdrawn from the cleaning stage 22 by the transport robot 28, and is transported to the cassette storing stage 14, then, is stored in a predetermined shelf of the stocker 27.

By the above process, the dressing for the grinding wheel 56 for rough grinding which is provided to the rough grinding stage 18 is completed. After that, the dressing for the grinding wheel 58 for the fine grinding which is provided to the fine grinding stage 20 is performed in the same manner as for the rough grinding wheel. Following the dressing of the grinding wheels of both stages, a normal process is restarted.

As presented above, the planarization apparatus 10 in the present embodiment can dress the grinding wheels 56 and 58 automatically without the operator. Therefore, the apparatus can be efficiently operated and at the same time, the accuracy of the dressing is constant.

In the above embodiment, the stocker 27 can store two dressing boards 29; however, the number of the dressing boards 29 to store in the stocker 27 is not limited. The stocker may store only one dressing board 29, or may store more than two.

Moreover, a location to provide the stocker 27 is not limited at the position mentioned in the present embodiment, either.

Figure 4:
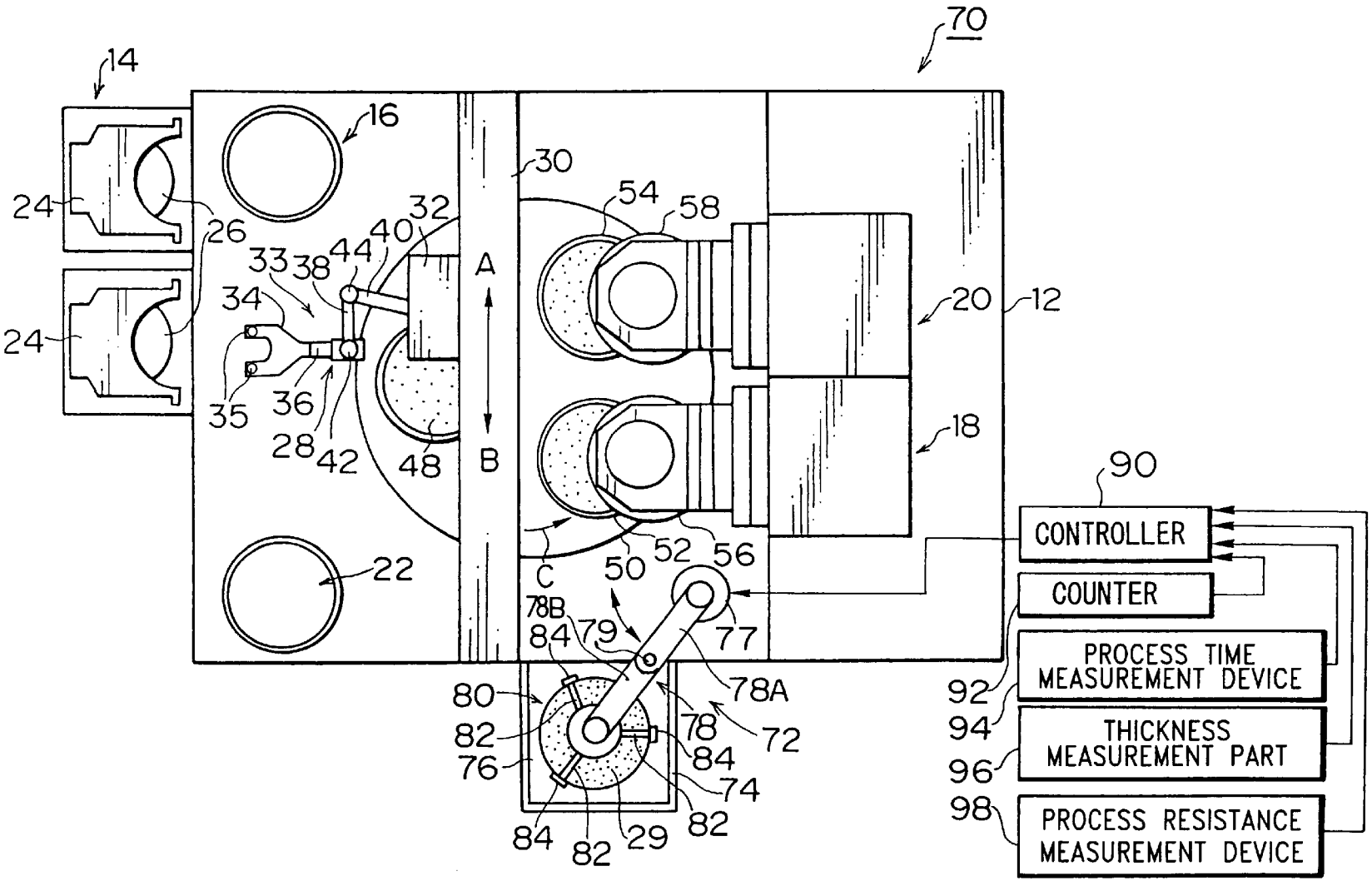
FIG. 4 is a perspective view of the first embodiment of the planarization apparatus of the present invention.

FIG. 4 is a plan view showing a planarization apparatus 70 according to the second embodiment of the present invention.

The planarization apparatus 70 differs from the planarization apparatus 10 of the first embodiment in that the one in this embodiment transports the dressing board 29 to the chuck table 52 by a transport robot 72 which is exclusively used for the dressing board. Thus in the description below, the members which are the same as the ones of the planarization apparatus 10 in the first embodiment are assigned the same numbers, and the description to them is omitted.

As shown in FIG. 4, a stocker stage 74 is placed near the rough grinding stage 18, and a stocker 76 in which dressing boards 29 (dressing boards for rough grinding and fine grinding) are stored is detachably mounted on the stocker stage 74. The dressing board transport robot 72 transports the dressing boards 29 which are stored in the stocker 76. to the chuck table 52 positioned at the rough grinding stage 18.

Figure 5:
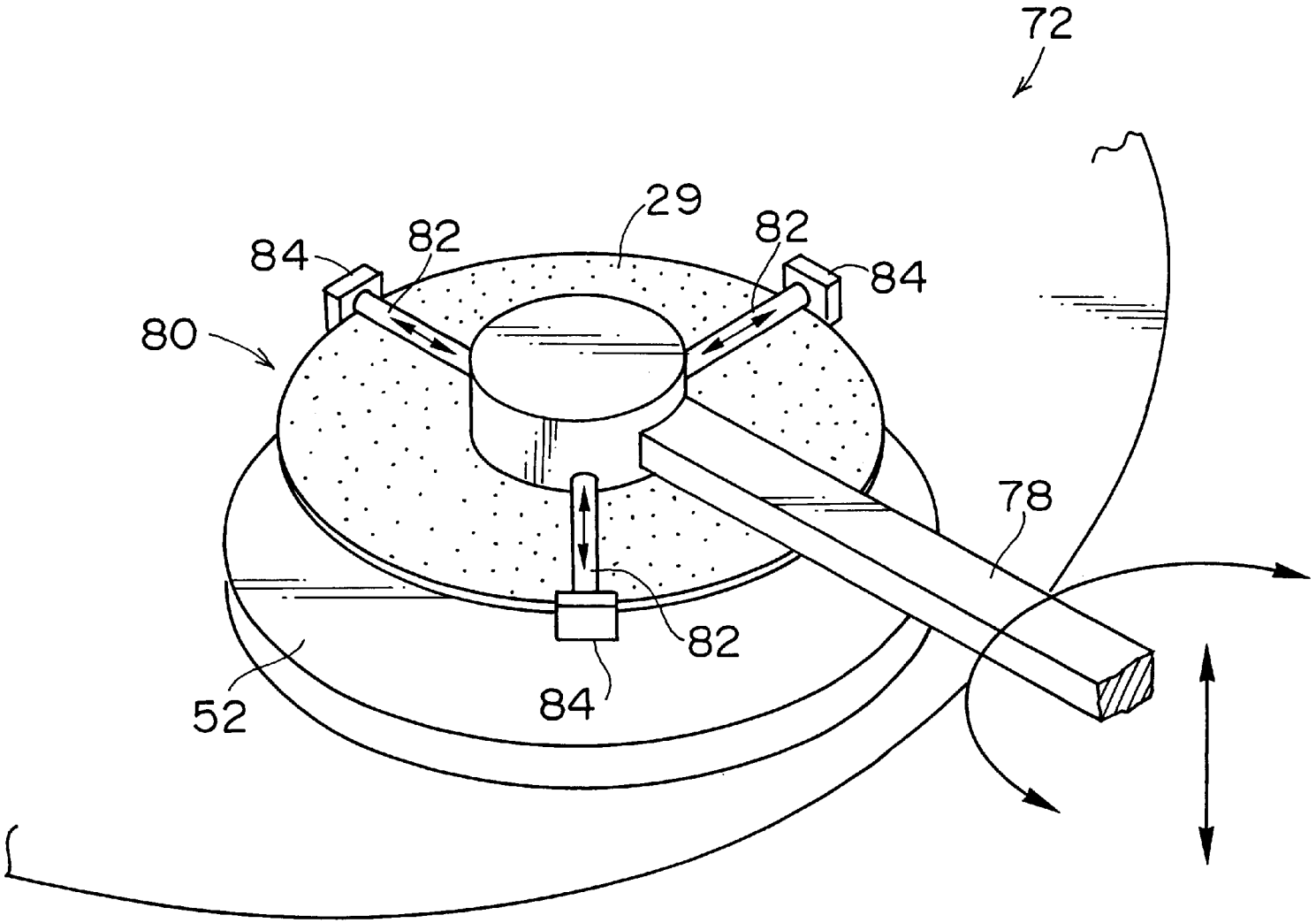
FIG. 5 is a perspective view showing the construction of essential parts of a dressing board transport robot.

The dressing board transport robot 72 is, as shown in FIGS. 4 and 5, comprises a multi-joints arm 78 and a chuck 80, which is provided to the tip of the arm 78.

The multi-joints arm 78 comprises a first arm 78A and a second arm 78B. The first arm 78A swivels by driving of a motor 77 and also moves up and down by driving of a cylinder (not shown). The second arm 78B is provided to the tip of the first arm 78A, and swivels around an axis 79 by driving of a motor (not shown).

The chuck 80 is provided to the tip of the second arm 78, and has three cramp arms 82, 82, and 82, which are arranged, at regular intervals. The cramp arms 82, 82, and 82 are provided to be capable of extending and contracting in radial directions by cylinders (not shown). The dressing board 29 is gripped with gripping nails 84, 84, and 84, which are provided to the tips of the extendable cramp arms 82, 82, and 82.

With the dressing board transport robot 72 which is constructed as described above, the dressing board 29 placed in the stocker 76 is gripped by the chuck 80, and is transported from the stocker 76 to the chuck table 52 which is positioned at the rough grinding stage 18 by swiveling and vertical motions of the multi-joints arm 78. The dressing board 29 placed on the chuck table 52 is gripped by the chuck 80, and is transported from the chuck table 52 to the stocker 76 by swiveling and vertical motions of the multi-joints arm 78. The driving of the dressing board transport robot 72 is controlled by the controller 90, and is operated in accordance with the driving signal from the controller 90.

An operation of the planarization apparatus 70 which is constructed as described above in the second embodiment is as presented below. The process of the wafer 26 is the same as the process by the planarization apparatus 10 in the first embodiment; hence, only a case for dressing grinding wheels 56 and 58 will be described.

First, the dressing board transport robot 72 picks up the dressing board 29 for the rough grinding wheel from the stocker 76, and transports the dressing board 29 to the chuck table 52 which is positioned at the rough grinding stage 18. After the transportation, the dressing board transport robot 72 returns to its original position (the position in FIG. 4).

The chuck table 52 on which the dressing board 29 is placed holds the dressing board 29 by suction, and starts the dressing after the dressing board transport robot 72 retreats. In other words, the chuck table 52 is rotated and the grinding wheel 56 is rotated, and the rotating grinding wheel 56 is lowered toward the rotating chuck table 52, so that the rotating grinding wheel 56 is pressed against the rotating dressing board 29 so as to dress the grinding wheel 56.

When the dressing is completed, the grinding wheel 56 retreats from the dressing board 29. The turn table 50 then rotates whereby the dressing board 29 is positioned at the wafer receiving position. The dressing board 29, positioned at the wafer receiving position, is released from the suction of the chuck table 48, and is transported to the cleaning stage 22 by the transfer robot 62, then, is cleaned and dried at the cleaning stage 22.

When cleaning and drying are completed, the dressing board 29 is withdrawn from the cleaning stage 22 by the transport robot 28, and is transported again to the chuck table 48 which is positioned at the wafer receiving position. Then, the turntable 50 rotates whereby the dressing board 29 is transported to the rough grinding stage 18.

As the dressing board 29 is transported to the rough grinding stage 18, the dressing board transport robot 72 picks up the dressing board 29 from the chuck table 52 and stores the dressing board 29 in the stocker 76.

By the above process, the dressing for the grinding wheel 56 for rough grinding which is provided to the rough grinding stage 18 is completed. Thereafter, the grinding wheel 58 for fine grinding which is provided to the fine grinding stage 20 is dressed in the same manner. After the grinding wheels of the both stages are dressed, a normal process will be restarted.

As described above, the planarization apparatus 70 in the present embodiment can dress the grinding wheels 56 and 58 without the operator like the planarization apparatus 10 in the first embodiment. Therefore, the apparatus can be operated efficiently while dressing accuracy is constant.

In the present embodiment, the stocker 76 is provided near the rough grinding stage 18; however, the position of the stocker 76 is not limited. The stocker 76 may be provided near the fine grinding stage 20 as well.

Moreover, a means for transporting the dressing board 29 from the stocker 76 to the chuck table 52 is not limited to the one in the present embodiment; the dressing board 29 may be held by the suction pads.

In the first and the second embodiments, the description has been given for dressing the grinding wheels 56 and 58; however the planarization apparatuses 10 and 70 in the present embodiments can perform truing with respect to the grinding wheels 56 and 58. In general, when replacing grinding wheels with new ones, the truing is performed to the new grinding wheels 56 and 58 in order to make the grinding wheels 56 and 58 be parallel with the chuck tables 48, 52, and 54. The planarization apparatuses 10 and 70 in the present embodiments can automatically perform truing to the grinding wheels 56 and 58 by performing the above-described dressing after replacing the grinding wheels.

Moreover, the planarization apparatuses 10 and 70 in the first and the second embodiments, the wafer 26 is processed with the grinding wheels 56 and 58 only; however, in a planarization apparatus with a stage to process wafers with a polishing pad, the polishing pad can be dressed as well.

The planarization apparatuses 10 and 70 in the above embodiments automatically dress when the wafers 26 in the number which has been set by the operator beforehand are processed; however the operator may voluntarily select a time for executing the dressing.

In the present embodiments, the controller 90 automatically executes the dressing when the wafers 26 in the predetermined number are processed. Alternatively, a process time measurement device 94 for measuring the cumulative process time of the wafer 26 may be provided. When the cumulative wafer process time measured by the process time measurement device 94 reaches a predetermined dressing execution time, the controller 90 automatically executes the dressing.

A process resistance measurement device 98 for measuring a process resistance during processing of the wafer may be provided, too. When the process resistance measured by the process resistance measurement device 98 reaches a predetermined value, the controller 90 automatically executes the dressing.

A thickness measurement part 96 for measuring the thickness of the cleaned and dried wafer 26 may be provided, and the controller 90 automatically executes the dressing in accordance with the result of the thickness measurement by the thickness measurement part 96. For example, a reference thickness may be set, and if thickness of the cleaned and dried wafer 26 measured by the thickness measurement part 96 is thicker than the reference thickness, the controller 90 automatically executes the dressing.

The number of processed wafers, the cumulative wafer process time, the process resistance, the reference thickness of the processed wafer, and so forth, for determining the execution of the dressing are preferred to be set by the operator at suitable values in accordance with data such as experiment data.

In the present embodiments, the dressing for the grinding wheel 56 for the rough grinding which is provided to the rough grinding stage 18 and the grinding wheel 58 for fine grinding which is provided to the fine grinding stage 20 are performed successively; however, the grinding wheels 56 and 58 may be managed individually, and may be dressed at different timings.

Further, the present embodiments perform dressing for the grinding wheel 56 for the rough grinding first, and then perform dressing for the grinding wheel 58 for fine grinding; however, the dressings for both grinding wheels may be performed simultaneously, thereby the dressing time can be shortened and the throughput can be improved.

As described above, the planarization apparatus of the present invention has the stocker for storing. the dressing board, and can automatically supply the dressing board stored in the stocker to the tables and withdraw them from the tables; thus can automatically dress the grinding wheels or the polishing pads without the operator. Therefore, the apparatus can be operated efficiently and the dressing accuracy is constant.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A planarization apparatus, comprising:

a table which holds a first face of a wafer by suction during processing of the wafer;

one of a grinding wheel and a polishing pad, the table and the one of the grinding wheel and the polishing pad being moved relatively close to each other to press the one of the grinding wheel and the polishing pad on a second surface of the wafer on the table and being rotated relatively to each other so as to process the second face of the wafer on the table;

a dressing board for dressing the one of the grinding wheel and the polishing pad, the one of the grinding wheel and the polishing pad being, when the table holds the dressing board instead of the wafer, pressed on the dressing board so as to dress the one of the grinding wheel and the polishing pad;

a stocker which stocks the dressing board;

a transporting device which picks up the dressing board from the stocker, transports the dressing board to the table, withdraws the dressing board from the table, and stores the dressing board in the stocker; and a controller which controls the transporting device and executes dressing of the one of the grinding wheel and the polishing pad.

2. The planarization apparatus as defined in claim 1, wherein:

a timing for the dressing is set in the controller; and the controller executes the dressing at the set timing.

3. The planarization apparatus as defined in claim 2, further comprising:

a counter which counts a number of wafers processed in the planarization apparatus, wherein the timing for the dressing is set by the number of the processed wafers so that the controller executes the dressing when the wafers of a predetermined number are processed.

4. The planarization apparatus as defined in claim 2, further comprising:

a process time measurement device which measures a cumulative wafer process time in the planarization apparatus, wherein the timing for the dressing is set by the cumulative wafer process time so that the controller executes the dressing when the cumulative wafer process time reaches a predetermined process time.

5. The planarization apparatus as defined in claim 2, further comprising:

a sensor which measures a process resistance experienced by the one of the grinding wheel and the polishing pad during processing of the wafer, wherein the timing for the dressing is set by the process resistance so that the controller executes the dressing when the measured process resistance reaches a predetermined process resistance.

6. The planarization apparatus as defined in claim 2, further comprising:

a sensor which measures a thickness of the wafer having been processed in the planarization apparatus, wherein the timing for the dressing is set by the thickness of the wafer having been processed so that the controller executes the dressing in accordance with the measured thickness of the wafer having been processed.

* * * * *